United States Patent [19]

Lane

[11] Patent Number: 4,596,082

[45] **Date of Patent: * Jun. 24, 1986**

[54] PERMANENT CALENDAR CONSTRUCTION

[76] Inventor: Ronald S. Lane, 406 Deer Creek Dr., Plainsboro, N.J. 08536

[ * ] Notice: The portion of the term of this patent subsequent to Jun. 30, 1998 has been disclaimed.

[21] Appl. No.: 726,188

[22] Filed: Apr. 23, 1985

Related U.S. Application Data

[63] Continuation of Ser. No. 584,101, Feb. 27, 1984, abandoned, which is a continuation of Ser. No. 205,211, Nov. 7, 1980, abandoned, which is a continuation of Ser. No. 10,336, Feb. 8, 1979, Pat. No. 4,275,516, which is a continuation-in-part of Ser. No. 966,165, Dec. 4, 1978, abandoned, which is a continuation-in-part of Ser. No. 798,273, May 19, 1977, Pat. No. 4,142,311, which is a continuation-in-part of Ser. No. 722,925, Sep. 13, 1976, abandoned.

[51] Int. Cl.[4] ..... G09D 3/00

[52] U.S. Cl. ..... 40/107; 40/120; 40/618

[58] Field of Search ..... 40/152.1, 107, 109, 40/618, 120, 19.5, 490, 122

[56] References Cited

U.S. PATENT DOCUMENTS

| | | | |
|---|---|---|---|
| 301,553 | 7/1884 | Bereman | 40/109 |
| 634,146 | 10/1899 | Maddox | 40/152.1 |
| 940,536 | 11/1909 | Lafferty | 40/618 |
| 1,481,467 | 1/1924 | Hockin | 40/618 |
| 1,748,984 | 3/1930 | Hogan | 40/618 |
| 2,291,703 | 8/1942 | Fifield et al. | 40/107 |
| 2,314,417 | 3/1943 | Neal | 40/152.1 |
| 2,401,241 | 5/1946 | Grobholz | 40/152.1 |
| 2,448,580 | 9/1948 | Crosby | 248/463 |
| 3,216,558 | 11/1965 | Marsh | 273/160 |
| 3,886,676 | 6/1975 | Alfonso | 40/618 |
| 3,930,327 | 1/1976 | Friedman | 40/618 |
| 4,275,516 | 6/1981 | Lane | 40/107 |

FOREIGN PATENT DOCUMENTS

| | | | |
|---|---|---|---|
| 2246393 | 3/1973 | Fed. Rep. of Germany | 40/19.5 |
| 542885 | 8/1922 | France | 248/463 |

*Primary Examiner*—Robert P. Swiatek

*Attorney, Agent, or Firm*—Darby & Darby

[57] ABSTRACT

An improved permanent calendar construction that allows easy removal and rearrangement of vertical date columns and yet prevents their disengagement when, for example, the calendar is tilted forward. Extending horizontally across the date column area or well, there is located at least one lipped horizontal track. Defined inthe back wall of each date column are at least two openings or grooves that can mate with the track, as desired. The lip results in a track which extends in more than one straight axial direction and thus engages the groove at least in dual directions (and with the end portion of the track furthest from the back wall terminating in an upwardly and perpendicular direction from an axis perpendicular to the back wall). An example of the preferred embodiment is a track with a right angle lip. Of course, at a minimum, the purposes of the present invention can be accomplished if the track is not lipped and is parallel to or diagonally upwardly directed toward the rear wall.

19 Claims, 14 Drawing Figures

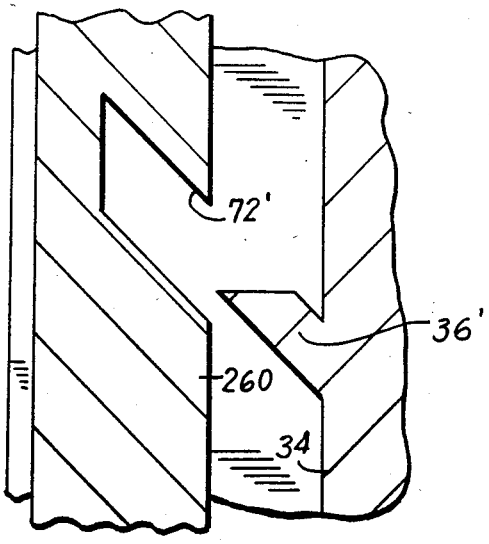
FIG. 10
PRIOR ART
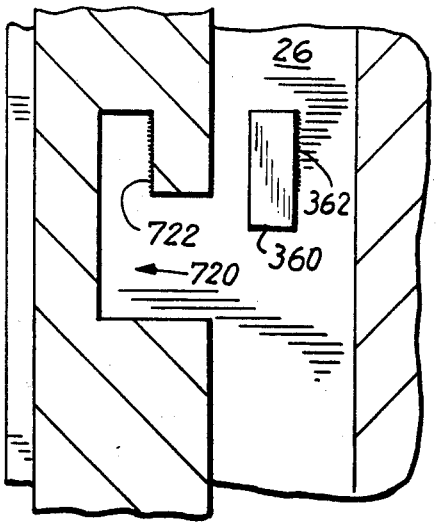
FIG. 8a
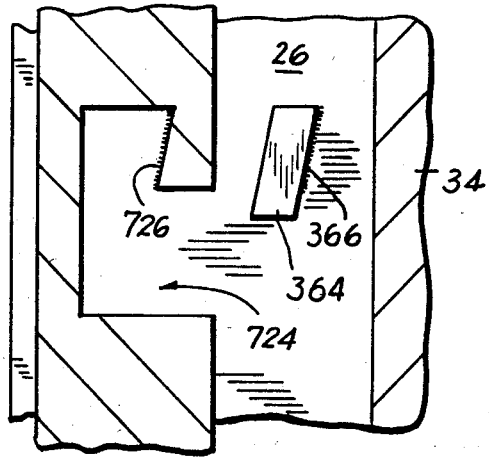
FIG. 8b
FIG. 8c
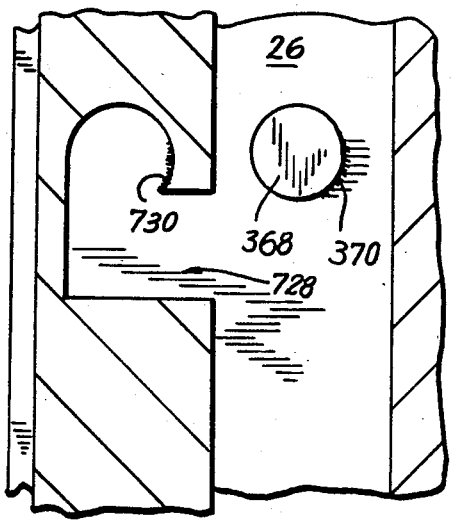
FIG. 8d
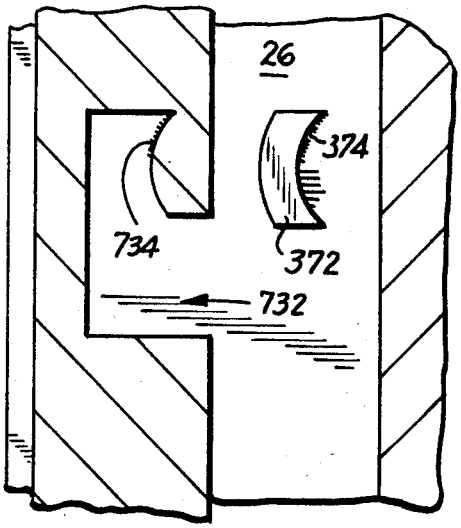

PERMANENT CALENDAR CONSTRUCTION

REFERENCE TO RELATED APPLICATIONS

This patent application is a continuation of application Ser. No. 584,101 filed Feb. 27, 1984 (now abandoned), which was a continuation of Ser. No. 205,211 filed Nov. 7, 1980 (now abandoned) which was a continuation of Ser. No. 10,336 filed Feb. 8, 1979 (now U.S. Pat. No. 4,275,516), which was a continuation-in-part of Ser. No. 966,165 filed Dec. 4, 1978 (now abandoned), which was a continuation-in-part of Ser. No. 798,273 filed May 19, 1977 (now U.S. Pat. No. 4,142,311), which was a continuation-in-part of Ser. No. 722,925 filed Sept. 13, 1976 (now abandoned), and the specifications of the prior applications are incorporated herein by reference.

BACKGROUND OF THE INVENTION

This invention relates primarily to improved permanent calendar constructions and, more particularly, to improvements in the means for detachably securing the vertical date columns to the main calendar body member and for calendar stands.

In my previous application, I have confronted and solved the problem of varying month lengths. In other words, I have provided means for varying the number of visually exposed numerals appearing on several of the vertical date columns. Depending upon the particular month in question, it is necessary every month to rearrange and reposition the vertical date columns, as well as adjust the rotatable members to account for the fact that months have varying lengths.

Two contradictory goals must be resolved. First, it is necessary to keep the vertical date columns firmly secured to the main body member so that the columns do not fall out easily from their normal positions, no matter what the position is of the main body member. Second, it is important that the columns be easily removable so that they may be rearranged on the main body member with a minimum of effort, and without requiring the calendar to be taken apart or to be taken off its normal viewing position or from its permanent attached position.

In the prior art references, those versions which are simple to rearrange have a design that allows the columns to fall off the main body members very easily. An example is U.S. Pat. No. 301, 553 in which it can be seen that the portions D which rest upon the portion B are such that the columns may be easily removed and may be easily slid horizontally along the tracks to adjust the calendar accordingly. However, as best seen in FIG. 1 of this reference, should the unit be tilted forward, there is nothing to prevent the element D from passing outwardly through the two members B within which it is esconced, and thus the vertical date columns will fall off the tracks B. Experience has shown this to happen quite often when changing the position of the columns, and this is quite annoying.

On the other hand, those prior art calendars which are structured to allow the columns to be securely maintained to the main body member, do so only at the cost of having to remove all of the columns in order to change any of them, or having to take the calendar apart to remove the columns, or removing the calendar from its normal position, such as the wall, requiring more effort than it is felt is necessary. An example of such prior art is U.S. Pat. No. 247,000. This reference discloses means to retain the vertical column blocks f in position. To change the blocks around, the whole unit must be disassembled by the removal of the slide h out of position in the side scripts a. The blocks are retained in position at the top by the slide g. The whole unit obviously must be disassembled to allow rearrangement of the calendar.

SUMMARY OF THE INVENTION

Accordingly, a primary object of the present invention is to provide an improved permanent calendar construction.

Yet another object of the present invention is to provide an improved permanent calendar construction which will allow the vertical date columns to be firmly secured and retained to the main calendar body member.

Still another object of the present invention is to provide a vertical date column which may be removed very easily from the main calendar body member and replaced thereon.

Still yet another object of the present invention is to provide a vertical date column which may be easily moved longitudinally and rearranged with respect to the main calendar body member with a minimum of effort.

Still yet another object of the present invention is to provide an improved permanent calendar construction in which the vertical date column will be securely retained to the main calendar body member, even though the member may be tilted forwardly and at an extreme angle.

Still yet another object of the present invention is to provide an improved support stand for the calendar which, when not being used, such as when the calendar is being stored or is hanging on the wall, or when in use, whether the calendar is being removed from a storage box or taken off a wall, will remain tightly and securely within the dimensions of the main body member at all times. Furthermore, it is easily moved to a supporting position, as desired, and will remain in that operative position even when the calendar is lifted off a support surface, such as when the columns are being changed.

Still yet a further object of the present invention is to provide an alternative embodiment of my basic calendar construction using only one or two reversible columns, trading accuracy for lower fabrication costs.

Still yet another object of the present invention is to provide a construction of the character described which will be simple and inexpensive to manufacture and yet be durable and simple to operate to a high degree in use.

These and other objects of the present invention are accomplished in a preferred and alternative embodiment of the present invention which features a permanent calendar construction similar to that described in my prior patent application. Positioned on the back wall of the date column well is at least one track running horizontally in the well-known fashion. This track may consist of a member which extends perpendicular to the back wall for a specified distance, and then a lip which extends perpendicular to the first horizontal portion and parallel to the back wall in an upward direction. The vertical date column may have at least two track-receiving grooves. The grooves are designed in approximately the same dimensional, although slightly taller, configuration as that of the lipped track. Thus, when the track is positioned in one of the two grooves, it is received within the right angle portion. If the main body member is tilted forward, the lip of the track prevents the vertical date column from falling off and out of engagement with the track. This is possible even though the main body member may be tilted forwardly to a point where it is approximately parallel to the ground.

Other examples of suitable construction would be the use of a semi-circular track in which the terminal point extends upwardly and parallel to the back wall. Another example of a suitable construction would be to make the first portion of the track extend upwardly at a 45 degree angle from the perpendicular and then have the lip extend upwardly at an angle of 135 degrees from the first portion so that the lip is parallel to the back wall.

In fact, any type of construction in which the lip track extends in at least two axial directions, the last being at an angle which provides a lip upwardly parallel to the rear wall, is basically sufficient to accomplish the purposes of the invention.

However, in all embodiments, the feature that accomplishes the purposes of the present invention is the fact that there are two opposing surfaces that engage each other when the calendar is tilted forward; the inner upward surface of the track closest to the back wall, and the opposed surface inside the groove in the column. The direction of these two surfaces at least at one point lie in a plane parallel to or pointing upwardly and rearwardly toward the vertical axis of the rear wall. Thus, when the calendar is upright, the column is hanging on the track and these two surfaces in opposed, spaced relationship (see e.g. FIG. 2) but, tilting the calendar forward causes engagement of these two surfaces preventing the column from falling off the track even when the calendar is parallel to the ground (see e.g. FIG. 6). In the prior art, the angle of the track points upwardly away from the rear wall allowing the column to fall off easily. Therefore, a construction having a track extending in a single, specified axial direction can also accomplish the results desired.

Other examples which accomplish this purpose is where the track is attached to the side walls and not to the rear wall. Still another example is where the track is composed of a dowel running from one side wall to another. Another example is where the lip of the track angles towards the rear wall. Another example is where the track protrudes rearwardly from the back of the column with a lip that points downward, and mates with a groove in the back wall of the main body.

It is also possible to construct this calendar out of plastic and in such an instance, it would be quite feasible to make the track a single straight member with a beaded end. This beaded end would match in a snap-fit within a groove or opening in the columns with the groove designed so that the width is slightly less at the surface than at the inner end to allow the appropriate snap engagement to be effective.

The support stand may consist of a single vertical member which is positioned within a cut-out and which has a pivot at its upper end and a rounded or angled inside wall. The pivot is biased towards either the right or left wall so that that wall engages the same wall of the cut-out, thus retaining the stand in normal non-operating position within the cut-out. This also allows it to be moved to the outer position or retains the stand in its outer position, when desired. The bottom wall is biased or cut at an angle so that when the stand is fully extended, the bottom wall will be parallel to and contiguous with a ground surface. Furthermore, the stand is easy to grasp.

The basic calendar construction can be fabricated with only one or two columns having reversible mounting structures. Thus, only the "31" date is reversible at the least. This lowers the cost of fabrication in exchange for a display which is not completely precise for February.

Other objects, features and advantages of the present invention will become apparent by reference to the following more detailed description of the preferred, yet illustrative embodiment of the present invention and reference to the accompanying drawings, wherein:

FIG. 8A is a view similar to FIG. 8 showing a unidirectional track secured to the side walls and the mating groove in the date column;

FIG. 8B is a view similar to FIG. 8A showing a modified embodiment thereof;

FIG. 8C is a view similar to FIG. 8A showing a multi-directional track and associated mating groove;

FIG. 8D is a view similar to FIG. 8C showing a modified embodiment thereof;

FIG. 10 is an enlarged, fragmentary cross-sectional view similar to FIG. 9, showing the teachings of the prior art.

Figure 1:
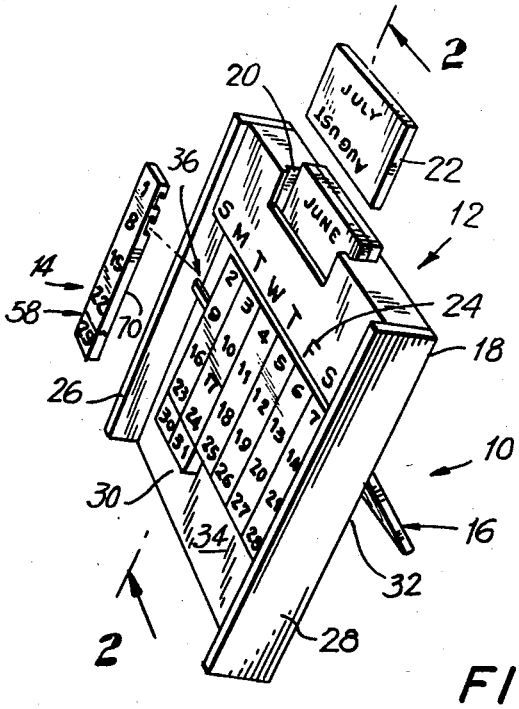
FIG. 1 is a front perspective, partially exploded view showing one of the vertical date columns in exploded position off the track, and showing one of the month display members in exploded position above the month receptacle.

Turning in detail to the drawings and, more particularly, to FIG. 1, there is shown a permanent calendar 10 comprising broadly a main body member 12, vertical date columns 14, and a support stand 16.

More specifically, the main body member 12 includes an upper portion 18 containing a month receptacle 20, in order to retain the months' display members 22. These units may be rearranged in the well-known fashion to display the appropriate month. The upper portion 18 also includes a weekday indicia 24 which permanently sets forth the columns for the particular days of the week for the month in question.

Depending downwardly from the upper position 18 is a left side wall 26 and a right side wall 28 defining the date column area or well 30 all within the lower portion 32. The well is bounded in the rear by a back wall 34.

Positioned on the back wall 34 and towards the upper portion 18 is a lipped track 36 as shown in the preferred embodiment. The track consists of a horizontal portion 38 which extends outwardly and perpendicular to the main axis of the back wall. The portion 38 is defined by an upper surface 40 and a lower surface 42. The portion also has a major horizontal axis 43 which is perpendicular to the major axis of the back wall. Extending upwardly from the horizontal portion 38 is a vertical portion 44 which is parallel to and spaced from the back wall and is perpendicular to the horizontal portion. The vertical portion is defined by an inner surface 46, an outer surface 48, and a top surface 50. The portion also has a vertical axis 51 which is perpendicular to the horizontal axis 43 of the horizontal portion 38.

The main body member 12 is bounded in the reverse side by a rear wall 52 having an opening 54 for a hanging hook. The rear wall also has defined therein a cutout portion 56 for the purpose hereinafter appearing.

The vertical date columns 14 are described in detail in my co-pending parent case Ser. No. 798,273 and the description therein is incorporated by reference. However, for purposes of this patent, the structure will be described as having a rotatable mounting structure 58 including an end piece 60 retained to the main column 14 by means of a screw 62 and a compression spring 64. The particular embodiment shown includes a ridge 66 defined in the date column. Of course, any type of means may be utilized to retain either permanently or detachably, an end piece to the vertical date column.

Defined in the rear wall 70 of the date column 14 are at least two track-receiving openings or grooves 72. The openings are defined by a horizontal base surface 74, depending inwardly from the outer wall. Then depending upwardly is a vertical surface 76 terminating at an upper horizontal surface 78 parallel to the horizontal surface 74. The surface depends outward towards the rear wall for a short distance and then there is depending downwardly therefrom a parallel opposed short vertical surface 80 and then another parallel opposed short horizontal upper surface 82. This surface is parallel to the surfaces 78, 74 and extends outwardly to the rear wall 70. The surfaces 74, lower part of 76 and 82 form a slot 88 and the surfaces including the upper part of 76, 78, 80 form a channel 89.

The width between the parallel vertical surfaces 76, 80 is defined as "X" and is identified by the numeral 84. In a similar matter, the distance between the parallel opposed vertical surface 76 and the rear wall 70 is defined by the width "Y" and identified by the reference numeral 86. Furthermore, the distance between the parallel opposed horizontal surfaces 74, 78 is defined by the width "Z" and identified by the reference numeral 87.

As stated previously, the more detailed description and the operation of the permanent calendar is described in my co-pending parent application Ser. No. 798,273.

One of the main features of the calendar resides in the construction of the track and the receiving groove. The track is designed in the preferred embodiment illustrated, to form a right angle. The width X is sufficient to receive the vertical portion in a comfortable and snug yet not overly tight fit. In the same fashion, the width Y is sufficient to correspond to the length of the upper surface 40 of the horizontal portion 38 of the track. When it is desired to place the date column on the track or remove it, the appropriate groove is selected and the track is received within that groove. The angle is sufficient to retain the track at all times, including in the position shown in FIG. 6 where the main body member 12 is in a forward horizontal position to the ground.

It is understood that several design considerations must be reviewed in order that this construction work properly. Among these considerations is the fact that the track in its preferred embodiment may be lipped, but it can be a single straight or curved element, as long as the end portion furthest from the back wall terminates at an angular direction which is upwardly from the perpendicular axis 43. Furthermore, this angle in the upward direction, can be no less than 90 degrees for obvious reasons. The more practical constructions will consist of a two element unit as shown, or it may consist of an inverted wedged shaped element substantially forming a trapezoid with the back wall, or it may consist of a horizontal element, and then a wedged shaped element with the inner surface extending diagonally upwardly. Another possible construction would be a curved chordal member resembling a portion of a washer. Any of these constructions are adequate as long as the vertical date column may be easily retained securely to said main body member, but may be easily removed, when so desired. Furthermore, the date members may be slid horizontally along the track with simplicity. Thus, these particular constructions, and especially the preferred embodiment, meet the dual, contradictory requirements of the perpetual calendar mentioned earlier.

Referring now to FIG. 10 of the drawings, there is shown a tracking groove combination designed in accordance with the prior art, further illustrating how easily the columns will fall from the tracks if the calendar is tilted forward. An excellent example of the prior art showing this construction is U.S. Pat. No. 301,553 to Bereman.

Referring now to FIGS. 8A–8D, there is shown constructions of the invention in its simplest and most direct form. There is shown a track 360 which is secured to the side wall 26 and 28 (not shown) of the calendar. It is noted that it is not secured to the back wall. The groove 720 is similar to the groove 72 except that the dimensions are not as critical. It is only necessary that the opening be sufficiently wide to allow passage of the track 370 into the bayonet slot section and to be able to bear against part or all of the inner surface 722. The portion 722 and the portion 362 of the track 360 are darkened in color to illustrate the point at which contact occurs between the two surfaces when the column is tilted forward. It is this contact that prevents the easy removal of the columns from the track during the tilting operation. Furthermore, it is this feature which is at its simplest, the essence of the invention.

Turning to FIG. 8B, there is seen a slight modification of this construction in that the track 364 now represents a parallelogram with the angles extending in the upwardly direction and towards the back wall 34. The groove 724 has the upper inner surface 726 which is also angled at the same degree as that of the surface 366 of the track 364. Once again, the appropriate engaging portions of both the track surface 366 and the surface 726, which meet when the whole unit is tilted forward, are shown in a darkened fashion so as to emphasize the surface of contact.

In a similar manner, FIG. 8C discloses a track 368 which is, in essence, a dowel mounted between the side walls 26 and 28 and which has a circular cross section.

The groove 728 has an upper circular terminal surface which has a chordal section and defining a portion of the surface designated by the reference numeral 730, in a like manner the appropriate portion of the outer surface of the track 368 is designated by the reference numeral 370. These portions are also darkened as previously mentioned so as to indicate those surfaces which engage when the unit is tilted forward.

Finally, FIG. 8D discloses a track 372 which is, in essence, a portion of a doughnut in which the top and bottom surfaces are parallel to each other. The groove 732 has a matching upper surface with the appropriate portion designated by the reference numeral 734. The appropriate portion of the inner surface of the track 372 is designated reference numeral 374. In the same manner, when the unit is tilted forward, the surface portions indicated by the darkened lines engage each other.

All the above-mentioned surfaces have a direction that at least one location lies in a plane that is either parallel to or points upwardly and rearwardly towards the vertical axis of the back wall. Therefore, engagement of these surfaces when the calendar is tilted forward prevents the calendar from falling off the track, as it would if the track were pointed away from the back wall as shown and illustrated in FIG. 10.

This construction is of great advantage because of the ease in which the columns may be removed and rearranged. This can be done simply by placing a finger at the bottom of the end piece and pushing upwardly and the column comes right out. Still the construction prevents the columns from falling or becoming detached, as previously mentioned. This occurs quite often when the calendar is being changed or when it is being examined for possible purchase, always to the users great annoyance.

By the ease and simplicity with which the columns may be removed, a minimum of columns have to be repositioned at any one time in order to set up the calendar for a new month, with the rest of the columns sliding to the left or the right in a fluid fashion along the track.

Figure 4:
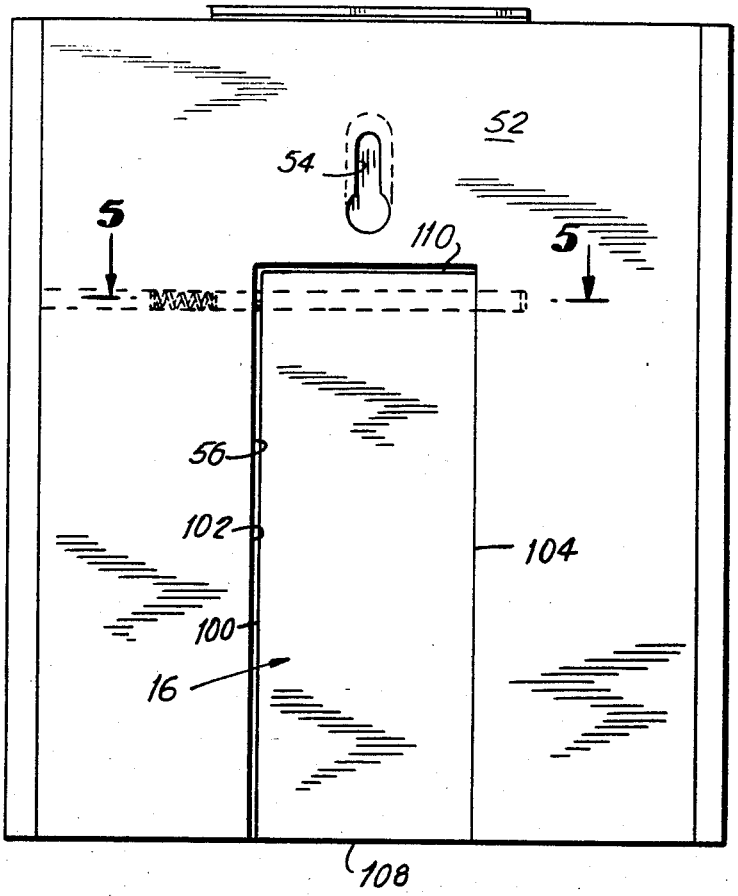
FIG. 4 is a rear elevational view of the main body member and with the stand in the retracted position.
Figure 5:
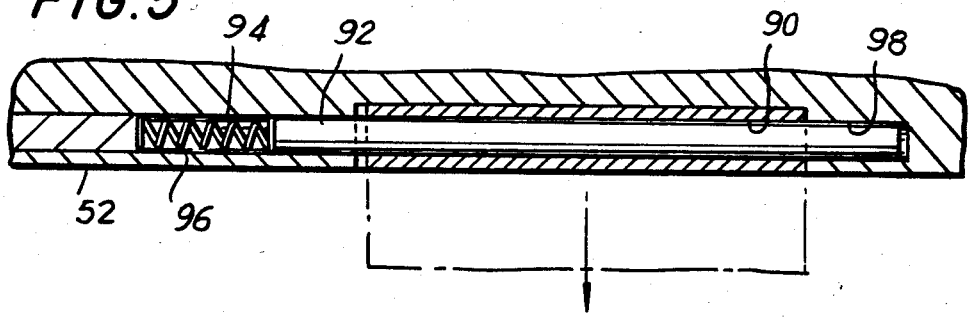
FIG. 5 is an enlarged partially cut-away sectional view taken along the line 5—5 of FIG. 4, and showing the stand in dotted line and in its extended position.

Yet another advantage of the present invention is the manner in which the support stand 16 is stored and utilized. The stand is defined by a top wall 110, a left side wall 100, and a bottom wall 108 and a right side wall 104. Near the top of the stand there is defined a thru bore in which is rigidly mounted a pivot rod 92. The rod is received within a left blind bore 94 located in the rear wall 52 of the main body member. Positioned between the end of the pivot rod and the blind inner wall of the bore is a compression spring 96. The other end of the pivot rod is received within the right blind bore 98. The purpose of the spring is to bias the stand to the right, as best seen in FIGS. 4 and 5, although any biasing means would be sufficient. Thus, the right side wall 104 engages the right side wall of the cut-out portion in frictional engagement. This allows the stand to be retained within its position within the cut out when it is not in use, or when it is in its operative position, functioning as a stand.

Figure 2:
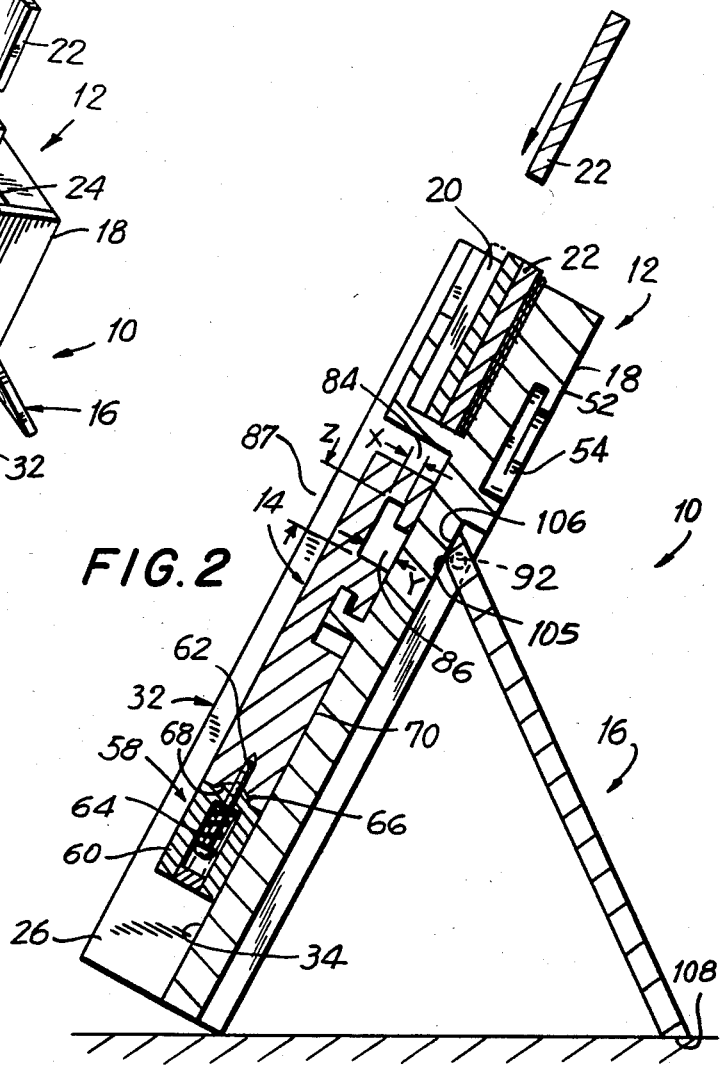
FIG. 2 is an enlarged cross-sectional view of FIG. 1 taken along the line 2—2 of FIG. 1.
Figure 3:
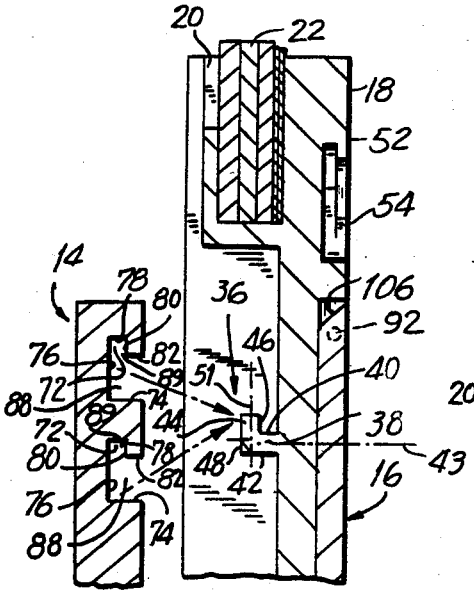
FIG. 3 is an enlarged partially cut-away sectional view, similar to FIG. 2, and showing the vertical date column exploded from the lipped track and showing the ability of either the grooves to be received on the track.

The upper inside wall of the stand is curved or angled as at 106. The curve is sufficient to allow the stand to be pivoted, but the curve terminates at a point when the desired extended angle between the stand and the rear wall 52 has been achieved. Of course, the wall may be angled, as well as curved. The bottom wall 108 is cut at a bias angle so that when the stand is extended, the bottom wall meets the ground surface in parallel abutment as best seen in FIG. 2. Furthermore, the bias cut makes the bottom wall easier to grasp, and thereby manipulate.

Figure 6:
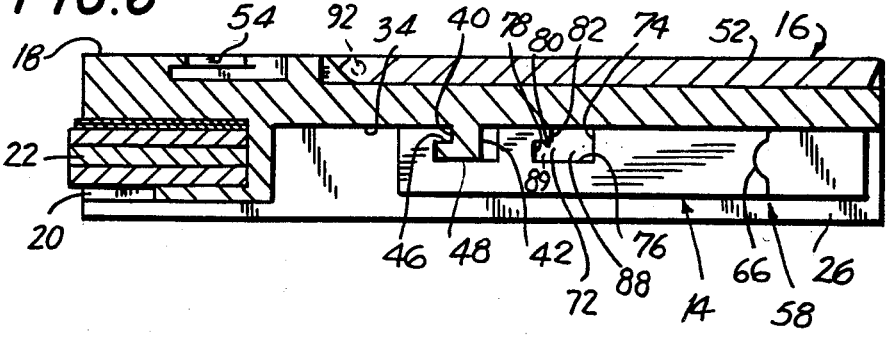
FIG. 6 is a cross-sectional view similar to FIG. 2 with the stand in retracted position, and showing the main body member in a tilted forward parallel position to the ground, with the vertical column illustrated being retained in operative position by the lipped track.

In operation, the support stand is normally received within the cut out 56 as best seen in FIGS. 6 and 4. When it is desired to utilize the cut out, the fingers easily grasp the wall 108 and the stand is pivoted as shown in FIG. 2, with the upper curved inside wall 105 pivoting to and ultimately bearing against the inner wall of the cut-out portion. In the extended position, the bias cut of the wall 106 is such that it meets the ground or the resting surface in parallel abutment. The bias of the spring 96 is such to retain the stand in frictional engagement with the right side wall of the cut-out portion 56. This engagement is such that the stand is retained within the cut-out portion when the stand is not in use, for example, when the opening 54 for the hanging hook is utilized; or is retained in the extended position even when the unit is lifted off the resting surface, thus overcoming gravitational effects.

Figure 7:
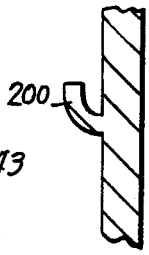
FIG. 7 is a view illustrating a semi-circular track.

Turning to the modified embodiment illustrated in FIG. 7, there is shown a lipped track 200 which, in essence, is a single semi-circular unit having its end terminating in a direction which is upwardly and substantially parallel to that of the back wall. The grooves or openings are conformed according to this shape. The resultant holding effect is substantially similar to that of the main embodiment.

Figure 8:
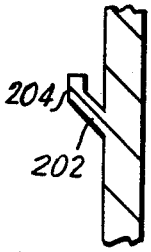
FIG. 8 is a view illustrating a track in which the first member is at a 45 degree angle to the back wall.

Turning to FIG. 8, it is seen that the first portion 202 of the track extends at a 45 degree angle upwardly and away from the back wall. Then the end portion 204 is secured at an angle of 135 degrees from the first portion 202 so that it terminates in an axial direction upwardly and substantially parallel to the surface of the back wall. The grooves or openings are likewise conformed to this particular configuration but this also serves substantially the same purposes as the main embodiment.

Figure 9:
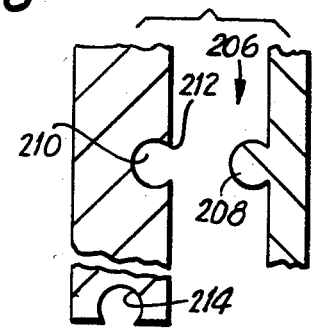
FIG. 9 is a modified embodiment of the present invention with the parts constructed of plastic.

Turning to FIG. 9, there is shown an embodiment in which the columns and the back wall may be fabricated of a plastic having elastic qualities such that the track 206 is defined by an extended cylindrical member 208. The grooved pocket opening 210 has a narrow portion 212 which expands to form the interior pocket. Because of the elastic qualities of the plastic, the member 208 is snapped through the opening 212 and eventually is seated within the opening 210 to insure a secure and positive fit between the column and the back wall. It is possible to place a finger groove 14 in the bottom wall of the end piece 58 or main body member 12 to facilitate disengagement.

I have noted that, if desired, a calendar construction could be fabricated with only one column having a reversible mounting structure 58 secured thereto. It would carry the numeral "31" on one of its faces. This would be sufficient for all the months of the year except February, for which the numerals "29" and "30" would always be exposed. However, this deficiency would be compensated by a reduction in complexity and cost of manufacture. If desired, a second column could carry a reversible mounting structure for the numeral "30".

While there has been shown and described preferred embodiments of the present invention, it is apparent that numerous alterations, omissions and additions may be made without departing from the spirit thereof.

I claim:

1. In an improved permanent calendar construction of the type having removable and rearrangeable vertical data columns, said calendar including a normally upright main body member having a back wall behind said date columns, the date columns being removably mated to said main body member by means of a horizontal track fitting into a groove, the improvement comprising:

each track and groove being dimensioned to permit date column movement toward and away from said back wall while the track and groove are fitted together, each track and groove having an engaging surface at least partially in a plane inclined upwardly and rearwardly towards the back wall so as to form an angle therewith, the engaging surface of a track and groove which are fitted together being in spaced relationship when said calendar is in its normally upright position, but coming into engagement when the calendar is tilted forward, thereby keeping the date columns firmly secured to the track, and yet allowing easy removal therefrom, and movement thereon as desired.

2. The invention according to claim 1, the track being secured to said back wall.

3. The invention according to claim 1, side walls secured to said back wall, the track being secured to said side walls.

4. A calendar in accordance with claim 1 wherein the surfaces which engage when the calendar is tilted forward are shaped so that weight of a date column urges it towards said back wall when the calendar is in its normal position.

5. An improved calendar construction in accordance with claim 4, further comprising:

a cut-out portion defined in the rear of said wall;

a support stand sized to be received within the cut-out portion;

means to bias its support stand towards one end of said cut-out portion causing frictional engagement therewith, the engagement sufficient to retain the support stand within the cut-out portions or in its standing position; and means further allowing pivotal movement of said stand to an extended position whereby the stand supports the permanent calendar on a ground surface, as desired.

6. The invention according to claim 5, wherein said pivotal means includes an upper inside wall on said stand, said upper inside wall being dimensioned to allow movement from a storage to a standing position.

7. The invention according to claim 5, wherein the support stand includes a bottom wall, said bottom wall cut at a bias angle so that it is easy to grasp when the stand is in storage position and it rests completely on a ground surface when the stand is in extended position.

8. An improved calendar construction in accordance with claim 1, further comprising:

a cut-out portion defined in the rear of said wall;

a support stand sized to be received within the cut-out portion;

means to bias its support stand towards one end of said cut-out portion causing frictional engagement therewith, the engagement sufficient to retain the support stand within the cut-out portion or in its standing position; and means further allowing pivotal movement of said stand to an extended position whereby the stand supports the permanent calendar on a ground surface, as desired.

9. The invention according to claim 8, wherein said pivotal means includes an upper inside wall on said stand, said upper inside wall being dimensioned to allow movement from a storage to a standing position.

10. The invention according to claim 8, wherein the support stand includes a bottom wall, said bottom wall cut at a bias angle so that is is easy to grasp when the stand is in storage position and it rests completely on a ground surface when the stand is in extended position.

11. In an improved permanent calendar construction of the type having removable and rearrangeable vertical date columns mounted thereon, said calendar including a main body member having a front wall behind said columns, the improvement comprising:

means on said main body for supporting said date columns, said supporting means including an engaging surface, at least a portion of which is disposed so that lines perpendicular to said portion and directed away from the surface thereof have a downward directional component when the calendar is upright; and an engaging surface on each date column positioned to confront said portion of said supporting means engaging surface in spaced relationship therefrom when the date column is mounted on the calendar, the supporting means and date column engaging surfaces engaging when the calendar is tilted forward, thereby keeping the date columns from falling away from the main body yet allowing easy movement thereon and removal therefrom.

12. A calendar according to claim 11 wherein said supporting means is a track supported in spaced relationship from said front wall.

13. An improved calendar construction in accordance with claim 11, further comprising:

a cut-out portion defined in the rear of said wall;

a support stand sized to be received within the cut-out portion;

means to bias its support stand towards one end of said cut-out portion causing frictional engagement therewith, the engagement sufficient to retain the support stand within the cut-out portions or in its standing position; and means further allowing pivotal movement of said stand to an extended position whereby the stand supports the permanent calendar on a ground surface, as desired.

14. The invention according to claim 13, wherein said pivotal means includes an upper inside wall on said stand, said upper inside wall being dimensioned to allow movement from a storage to a standing position.

15. The invention according to claim 13, wherein the support stand includes a bottom wall, said bottom wall cut at a bias angle so that it is easy to grasp when the stand is in storage position and it rests completely on a ground surface when the stand is in extended position.

16. A calendar in accordance with claim 11 wherein the surfaces which engage when the calendar is tilted forward are shaped so that weight of a date column urges it towards said front wall when the calendar is in its normal position.

17. An improved calendar construction in accordance with claim 16, further comprising:

a cut-out portion defined in the rear of said wall;

a support stand sized to be received within the cut-out portion;

means to bias its support stand towards one end of said cut-out portion causing frictional engagement therewith, the engagement sufficient to retain the support stand within the cut-out portions or in its standing position; and means further allowing pivotal movement of said stand to an extended position whereby the stand supports the permanent calendar on a ground surface, as desired.

18. The invention according to claim 17, wherein said pivotal means includes an upper inside wall on said stand, said upper inside wall being dimensioned to allow movement from a storage to a standing position.

19. The invention according to claim 17, wherein the support stand includes a bottom wall, said bottom wall cut at a bias angle so that it is easy to grasp when the stand is in storage position and it rests completely on a ground surface when the stand is in extended position.

* * * * *